US006876156B1

(12) United States Patent
Yamamoto et al.

(10) Patent No.: US 6,876,156 B1
(45) Date of Patent: Apr. 5, 2005

(54) ELECTRON-EMITTING DEVICE, ELECTRON SOURCE USING THE SAME, AND IMAGE FORMING APPARATUS USING THE SAME

(75) Inventors: Keisuke Yamamoto, Yamato (JP); Miki Tamura, Isehara (JP); Yasuhiro Hamamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/513,129

(22) Filed: Feb. 25, 2000

(30) Foreign Application Priority Data

| | | |
|---|---|---|
| Feb. 26, 1999 | (JP) | 11-051952 |
| Feb. 26, 1999 | (JP) | 11-051965 |
| Feb. 26, 1999 | (JP) | 11-051973 |
| Feb. 26, 1999 | (JP) | 11-052013 |
| Feb. 26, 1999 | (JP) | 11-052025 |
| Feb. 26, 1999 | (JP) | 11-052027 |
| Feb. 15, 2000 | (JP) | 2000-041452 |

(51) Int. Cl.[7] ..... G09G 3/10; H01J 1/62

(52) U.S. Cl. ..... 315/169.3; 315/169.4; 313/495; 313/496; 345/76; 345/74

(58) Field of Search ..... 315/169.3, 169.4, 315/169.1; 313/495, 496, 310, 313, 309; 345/76, 74, 75, 77; 427/126.1

(56) References Cited

U.S. PATENT DOCUMENTS

| | | | | |
|---|---|---|---|---|
| 4,954,744 A | * | 9/1990 | Suzuki et al. | 313/336 |
| 5,470,265 A | | 11/1995 | Nomura et al. | 445/24 |

(Continued)

FOREIGN PATENT DOCUMENTS

| | | |
|---|---|---|
| EP | 0 660 357 | 6/1995 |
| EP | 0 850 892 | 7/1998 |
| JP | 07-235255 | 9/1995 |
| JP | 7-235255 | 9/1995 |
| JP | 08-273523 | 10/1996 |
| JP | 2854385 | 11/1998 |
| JP | 2000-285789 | 10/2000 |
| JP | 2001-014822 | 1/2001 |
| JP | 2001-148222 | 1/2001 |

OTHER PUBLICATIONS

M.I. Elinson et al., "The Emission of Hot Electrons and The Field Emission of Electrons From Tin Oxide", Radio Engineering and Electronic Physics, Jul. 1965, pp. 1290–1296.

H. Araki, "Electroforming and Electron Emission of Carbon Thin Films", Journal of the Vacuum, Society of Japan, 1983, pp. 22–29 (with English Abstract on p. 22).

G. Dittmer, "Electrical Conduction and Electron Emission of Discontinuous Thin Films", Thin Solid Films, 9, 1972, pp. 317–328.

M. Hartwell, "Strong electron Emission From Patterned Tin–Indium Oxide Thin Films", IEDM, 1975, pp. 519–521.

M.W. Geis et al., *A New Surface Electron–Emission Mechanism In Diamond Cathodes*, Nature vol. 363, Jun. 1998, pp. 431–435.

M.G. Gels et al., *Theory And Experimental Results Of A New Diamond Surface–Emission Cathode*, The Lincoln Laboratory Journal, vol. 10, No. 1, 1997, pp. 3–16.

*Primary Examiner*—Tuyet Thi Vo
(74) *Attorney, Agent, or Firm*—Fitzpatrick, Cella Harper & Scinto

(57) ABSTRACT

In an electron-emitting device having a pair of electric conductors disposed on a substrate in opposed relationship with each other, and a pair of piled films composed chiefly of carbon and connected to the pair of electric conductors and disposed with a gap interposed therebetween, the piled films contain therein one or more kinds of elements selected from the group of lithium, potassium, sodium, calcium, strontium and barium within the range of 1 mol % to 5 mol % in terms of the percentage to carbon.

21 Claims, 9 Drawing Sheets

U.S. PATENT DOCUMENTS 5,578,897 A 11/1996 Nomura et al. ..... 313/310
5,622,634 A * 4/1997 Noma et al. ..... 216/40
5,674,100 A * 10/1997 Ono et al. ..... 445/24
5,716,618 A * 2/1998 Tomida et al. ..... 427/126.1
5,831,387 A * 11/1998 Kaneko et al. ..... 313/495
5,939,824 A * 8/1999 Kishi et al. ..... 313/495
5,986,389 A 11/1999 Tsukamoto ..... 313/310
6,147,449 A * 11/2000 Iwasaki et al. ..... 313/495
6,169,356 B1 1/2001 Ohnishi et al. ..... 313/495
6,208,071 B1 3/2001 Nishimura et al. ..... 313/495
6,221,426 B1 * 4/2001 Yamanobe ..... 427/77
6,259,422 B1 7/2001 Hamamoto ..... 345/74.1
6,313,815 B1 * 11/2001 Takeda et al. ..... 345/75.2

* cited by examiner

ELECTRON-EMITTING DEVICE, ELECTRON SOURCE USING THE SAME, AND IMAGE FORMING APPARATUS USING THE SAME

BACKGROUND OF THE INVENTION

1. Field of the Invention

This invention relates to an electron-emitting device, an electron source constituted thereby, and an image forming apparatus such as a display apparatus which is the application thereof, and particularly to a surface conduction electron-emitting device of novel construction, an electron source using the same, and an image forming apparatus such as a display apparatus which is the application thereof.

2. Related Background Art

A surface conduction electron-emitting device utilizing the phenomenon that electron emission is caused by flowing an electric current to electrically conductive film formed on a substrate.

As examples of this surface conduction electron-emitting device, there have been reported one using $SnO_2$ thin film [M. I. Elinson, Radio Eng. Electron Phys., 10, 1290 (1965)], one using Au thin film [G. Ditmmer, Thin Solid Films, 9, 317 (1972)], one using $In_2O_3/SnO_2$ thin film [M. Hartwell and C. G. Fonsted, IEEE Trans. ED Conf., 519 (1975)], and one using carbon thin film [Hisashi Araki, et al., Vacuum, Vol. 26, No. 1, P.22 (1983)].

In these surface conduction electron-emitting devices, it has been usual to carry out a power supplying process called "forming" on the electrically conductive film to thereby bring about a state in which electron emission occurs before electron emission is effected.

Here, "forming" is to apply a constant voltage or a voltage slowly rising at a rate of e.g. 1 V/min. or so to the opposite ends of the electrically conductive film, flow an electric current to the electrically conductive film, locally destroy, deform or change the quality of the electrically conductive film and bring about an electrically high resistance state to thereby bring about a state in which electron emission occurs.

By this process, a fissure is formed in a portion of the electrically conductive film, and the phenomenon of electron emission is considered to be attributable to the presence of this fissure. Although in what portion the actual electron emission occurs has not been completely elucidated, the fissure and the area around it are in some cases called "on electron-emitting region" for the sake of convenience.

The applicant has already made many propositions regarding the surface conduction electron-emitting device. For example, regarding the above-described "forming", the applicant discloses in Japanese Patent No. 2,854,385, U.S. Pat. No. 5,470,265 and U.S. Pat. No. 5,578,897 that it is preferable to effect the forming by applying a pulse voltage to electrically conductive film.

Here, the waveform of the pulse voltage may be by any of a method of maintaining the crest value constant as shown in FIG. 5A of the accompanying drawings, and a method of gradually increasing the crest value as shown in FIG. 5B of the accompanying drawings, and can be suitably chosen with the shape and material of the device and the conditions of the forming taken into account.

Also, subsequently to the forming, it has been found that in an atmosphere containing organic substances, a pulse voltage is repetitively applied to the electron-emitting device, whereby both of a current flowing to the device (device current If) and a current resulting from electron emission (emission current Ie) are increased, and this processing is called "activation".

This processing forms a deposit composed chiefly of carbon on an area including the fissure formed in the electrically conductive film by the "forming", and the details thereof are disclosed in Japanese Patent Application Laid-Open No. 7-235255.

When the surface conduction electron-emitting device as described above is applied to an image forming apparatus or the like, low power consumption and high luminance are more required.

Accordingly, as the performance of the electron-emitting device, it has come to be required more than even that the proportion of the emission current Ie to the device current If, i.e., the electron emission efficiency, be made higher.

Also, it is a matter of course that it is necessary to prevent a variation in performance with time by electron emission being continued from becoming greater than in the prior art when such an improvement in performance is to be achieved.

SUMMARY OF THE INVENTION

It is an object of the present invention to provide an electron-emitting device excellent in electron emission characteristic, an electron source using the same, and an image forming apparatus using the same.

The present invention is an electron-emitting device having a pair of electric conductors disposed on a substrate in opposed relation ship with each other, and a pair of piled films composed chiefly of carbon and connected to the pair of electric conductors and disposed with a gap interposed therebetween, characterized in that the piled films contain therein one or more kinds of elements selected from the group of lithium, potassium, sodium, calcium, strontium and barium within the range of 1 mol % to 5 mol % in terms of the percentage to carbon.

Also, the present invention is an electron-emitting device provided with a pair of device electrodes disposed on a substrate in opposed relationship with each other, electrically conductive film connected to the pair of device electrodes and having a fissure between the pair of device electrodes, and a deposit composed chiefly of carbon and formed in the fissure and on an area including the fissure and having in the fissure a gap of a width narrower than the fissure, characterized in that the deposit contains therein one or more kinds of elements selected from the group of lithium, potassium, sodium, calcium, strontium and barium within the range of 1 mol % to 5 mol % in terms of the percentage to carbon.

DESCRIPTION OF THE PREFERRED EMBODIMENTS

In the present invention, an electron-emitting device having a pair of electric conductors disposed on a substrate in opposed relationship with each other, and a pair of piled films composed chiefly of carbon and connected to the pair of electric conductors and disposed with a gap interposed therebetween is characterized in that the piled films contain therein one or more kinds of elements selected from the group of lithium, potassium, sodium, calcium, strontium and barium within the range of 1 mol % to 5 mol % in terms of the percentage to carbon.

Also, in the present invention, an electron-emitting device provided with a pair of device electrodes disposed on a substrate in opposed relationship with each other, electrically conductive film connected to the pair of device electrodes and having a fissure between the pair of device electrodes, and a deposit composed chiefly of carbon and formed in the fissure and on an area including the fissure and having in the fissure a gap of a width narrower than the fissure is characterized in the at the deposit contains therein one or more kinds of elements selected from the group of lithium, potassium, sodium calcium, strontium and barium within the range of 1 mol % to 5 mol % in terms of the percentage to carbon.

Also, the electron source of the present invention is characterized by the provision of a plurality of electron-emitting devices disposed on a substrate, and wirings connected to these electron-emitting devices.

Also, the image forming apparatus of the present invention is characterized by the provision of the electron source, and an image forming member for effecting image information by electrons emitted from the electron source colliding against it.

Some preferred embodiments of the present invention will hereinafter be described in detail by way of example with reference to the drawings. However, the dimensions, materials, shapes and relative disposition of constituent parts described in these embodiments are not restricted to the ranges of the present invention unless otherwise specified.

Figure 1A:
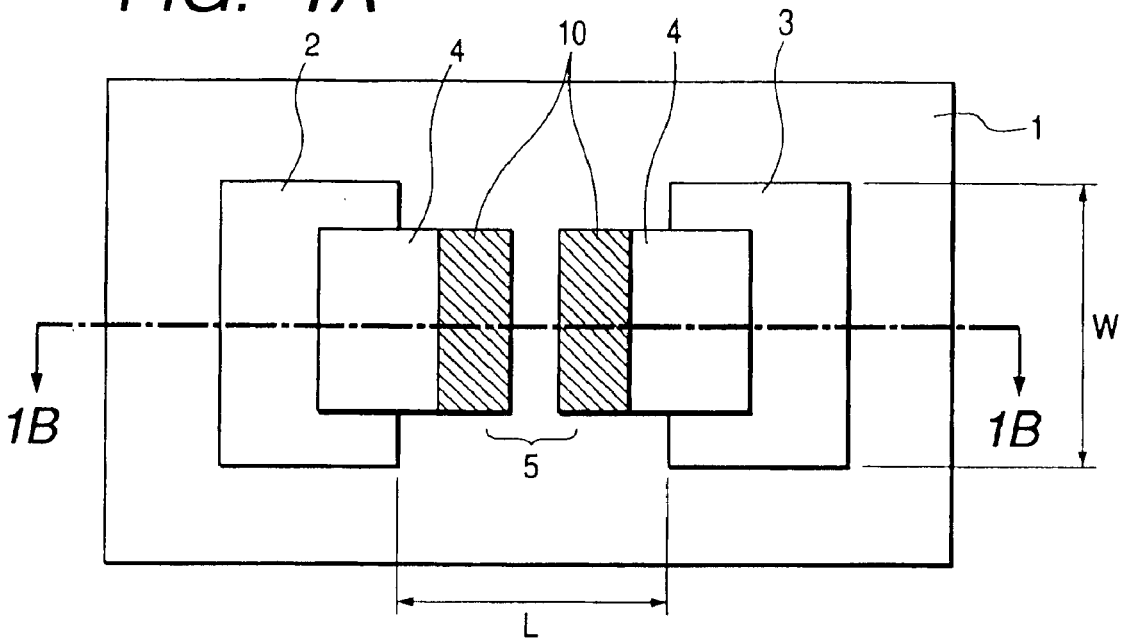
FIGS. 1A and 1B are typical views schematically showing the construction of an electron-emitting device according to an embodiment of the present invention.
Figure 1B:
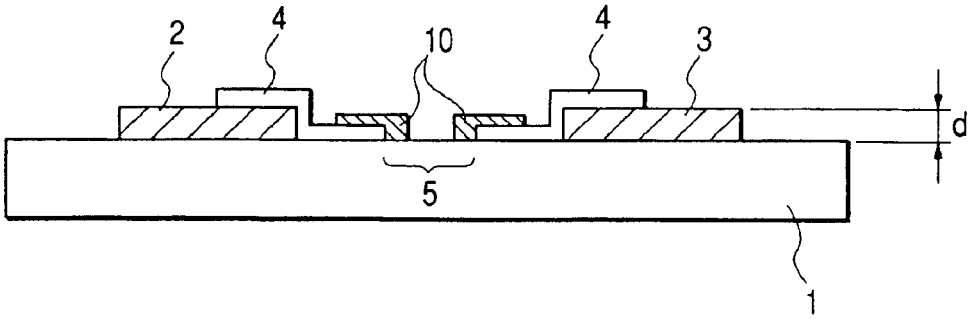

Reference is first had to FIGS. 1A and 1B to describe the basic construction of an electron-emitting device according to an embodiment of the present invention. FIGS. 1A and 1B are typical views schematically showing the construction of the electron-emitting device according to the embodiment of the present invention, FIG. 1A being a typical plan view thereof, and FIG. 1B being a typical cross-sectional view (a cross-sectional view taken along the line 1B—1B of FIG. 1A) thereof.

In FIGS. 1A and 1B, the reference numeral 1 designates a substrate as a base body formed of an insulative material, and a pair of device electrodes 2 and 3 disposed in opposed relationship with each other are provided on this substrate 1, and electrically conductive films 4 connected to the pair of device electrodes 2 and 3 are also provided on the substrate 1.

In the illustrated embodiment, there is shown a case where as described above, an electric conductor is constituted by the device electrodes 2, 3 and the electrically conductive films 4, but an equal function as the electron-emitting device can be displayed even if the electrically conductive films 4 are eliminated and the electric conductor is constituted by only the device electrodes 2 and 3.

Also, in FIGS. 1A and 1B, the reference numeral 5 typically represents a fissure formed in the electrically conductive films 4, and this fissure 5 is provided between the pair of device electrodes 2 and 3.

In FIGS. 1A and 1B, the reference numeral 1 designates a substrate as a base body formed of an insulative material, and a pair of device electrodes 2 and 3 disposed in opposed relationship with each other are provided on this substrate 1, and electrically conductive films 4 connected to the pair of device electrodes 2 and 3 are also provided on the substrate 1.

These deposits 10 chiefly composed of carbon are formed not only around the fissure 5, but also in the fissure 5, and are formed in the fissure 5 so as to have a gap narrower than the fissure 5.

Figure 2:
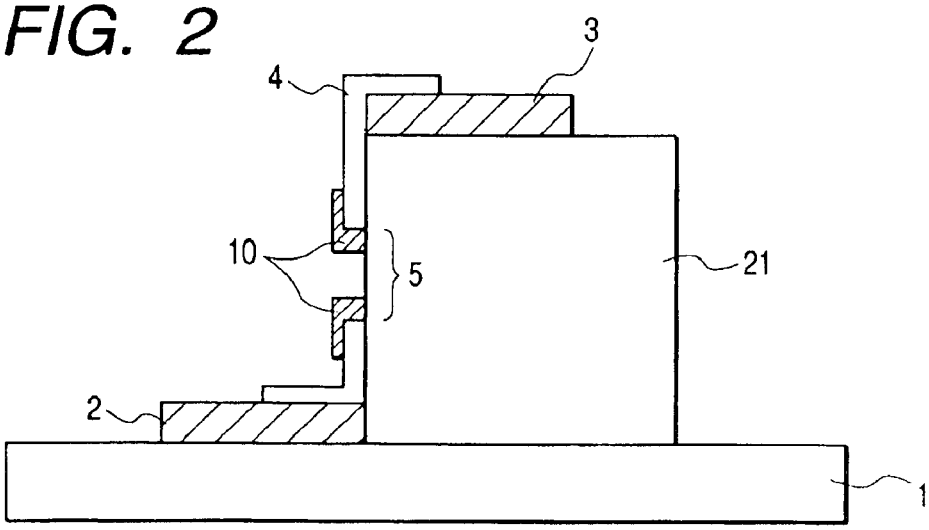
FIG. 2 is a typical cross-sectional view of an electron-emitting device according to an embodiment of the present invention.

As another basic construction of the electron-emitting device, there is also one of a step type as shown in FIG. 2. FIG. 2 is a typical cross-sectional view of an electron-emitting device according to an embodiment of the present invention.

In FIG. 2, the reference numeral 21 designates a step-forming member formed of an insulative material and provided on the substrate 1 to form a step. In the other points, the basic construction of this embodiment is the same as that shown in FIGS. 1A and 1B, and the same portions as those in FIGS. 1A and 1B are given the same reference numerals.

As the nature required of the device electrodes 2 and 3, it is necessary to have sufficient electrical conductivity, and as the material thereof, mention may be made of a metal, an alloy or an electrically conductive metal oxide, or a print conductor formed of a mixture of them and glass, or a semiconductor.

To preferably effect the formation of the fissure by forming, that is, to preferably effect the imparting of electron-emitting capability, it is preferable to form the electrically conductive films 4 by fine particles of an electrically conductive substance. As the material thereof, use can be made of an electrically conductive material such as Ni, Au, PdO, Pd or Pt.

Above all, PdO is a preferred material because it has the merits that it can readily form electrically conductive film comprising fine particles by being sintered in the atmosphere after organic Pd compound film has been formed, that it is a semiconductor and is therefore lower in electric conductivity than metals and is easy to control so as to obtain a suitable resistance value for forming, and that it can be reduced relatively easily and therefore, after a fissure has been formed by forming, it can be made into a metal Pd to thereby reduce the resistance thereof.

The formation of the deposits 10 composed chiefly of carbon can be effected by the aforedescribed "activating" method.

As the control of the quantity of one or more kinds of elements selected from the group of lithium, potassium, sodium, calcium, strontium and barium (hereinafter referred to as Li, K, Na, Ca, Sr and Ba, respectively) contained in the deposits 10 composed chiefly of carbon, there can be adopted a method of introducing a raw material gas containing desired one of the above-mentioned elements into an atmosphere containing organic substances when activation is effected, and controlling the quantity thereof, or a method of applying a solution containing desired one of the above-mentioned elements in the form of an organic metal compound or the like, and then heat-processing it to thereby make it contain a desired element, and controlling the amount of application of the solution.

According to my study, it has been found that when 1 mol % or more of the above-mentioned element (in the case of a plurality, the sum total of all elements) in terms of the percentage to carbon is contained, electron-emitting efficiency is improved.

On the other hand, it has been found that if the content becomes too great, when electron emission is continuedly effected, the speed at which the emitted current decreases becomes higher than that when these elements are not contained (that is, stability is reduced). Regarding this point as well, I have found that if the content of the above-mentioned elements is 5 mol % or less to carbon, stability is virtually not adversely affected, and have come to make the present invention.

The reason for this is not sufficiently grasped, but yet it is known that at least a portion of the deposits composed chiefly of carbon has graphite structure, and it is well known that the above-mentioned elements are contained in graphite, whereby electric conductivity is increased. It is also well known that an oxide of the above-mentioned elements or the like has a very low work junction, and I presume that these circumstances act advantageously on an improvement in electron-emitting efficiency. Also, I presume that the reason why stability is adversely effected if the content becomes great is related to the fact that the crystalline property of the portion of graphite structure is reduced.

Description will now be made of a more specific embodiment constructed on the basis of the above-described embodiment of the present invention.

(Embodiment of the Electron-Emitting Device)

An electron-emitting device according to the present embodiment is similar in construction to that shown in FIGS. 1A and 1B.

A method of manufacturing the electron-emitting device according to the present embodiment will herein after be described on the basis of FIGS. 1A and 1B and FIGS. 3A to 3D.

(Step-a)

First, a pattern of photoresist was formed on the washed quartz substrate 1 so as to have openings corresponding to the shapes of the device electrodes 2 and 3, and Ti of a thickness 5 nm and Pt of a thickness 30 nm were successively piled thereon.

Figure 3A:
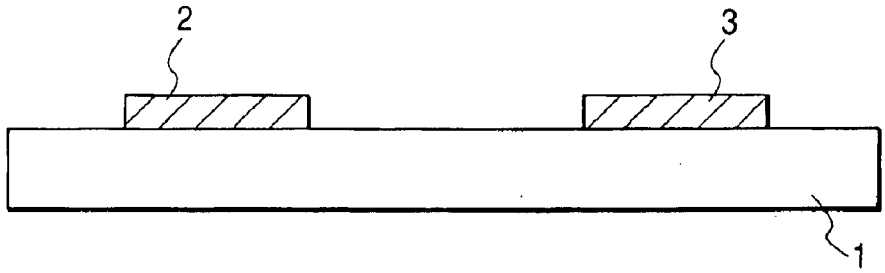
FIGS. 3A, 3B, 3C and 3D are illustrate the steps of manufacturing the electron-emitting device according to the embodiment of the present invention.

Then, the pattern of the photoresist was dissolved by an organic solvent and removed, and electrodes comprising Pt/Ti layered film were formed by the technique of lift-off. Here, the electrode interval L was 50 $\mu$m, the electrode width W was 300 $\mu$m (FIG. 3A).

By the vacuum evaporation method, Cr film was formed to a thickness of 100 $\mu$m, and then, by the technique of photolithography, the Cr film was patterned so as to have an opening corresponding to the shape of electrically conductive film which will be described later. Thereafter a solution of an organic Pd compound (ccp 4230 produced by Okuno Seiyaku Ltd.) was applied by the use of a spinner, and was dried, whereafter heat processing at 350° C. was effected in the atmosphere for 13 minutes.

By this processing, electrically conductive film of a thickness 10 nm comprising PdO fine particles was formed. The sheet resistance Rs of this film was $2\times10^4$ Ω/□.

The sheet resistance Rs is an amount represented as R=(l/w)Rs when the resistance value measured with a current flowed in the lengthwise direction of film having a length 1 and a width w is defined as R, and is represented by Rs=ρ/t with resistivity as ρ and film thickness as t if film is uniform.

(Step-c)

Figure 3B:
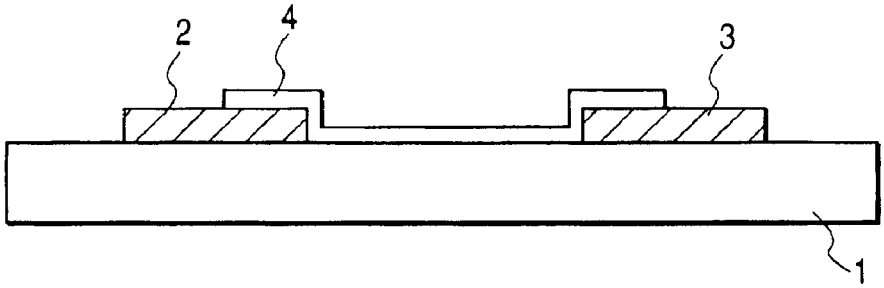

The Cr film was removed by Cr etchant, and by the technique of lift-off, the electrically conductive film was patterned into a desired shape (FIG. 3B).

(Step-d)

Figure 3C:
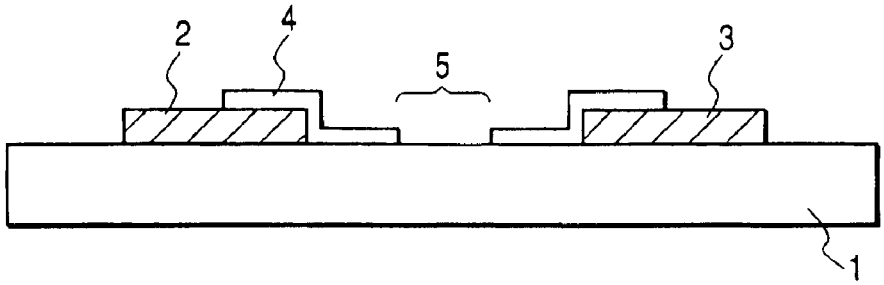

The above-described device was installed in a vacuum processing apparatus, and the pressure in a vacuum chamber was lowered to $2.7\times10^4$ Pa by an exhauster, whereafter a pulse voltage was applied to between the device electrodes 2 and 3 to thereby effect forming, and a fissure 5 was formed in a portion of the electrically conductive film (FIG. 3C).

Figure 5A:
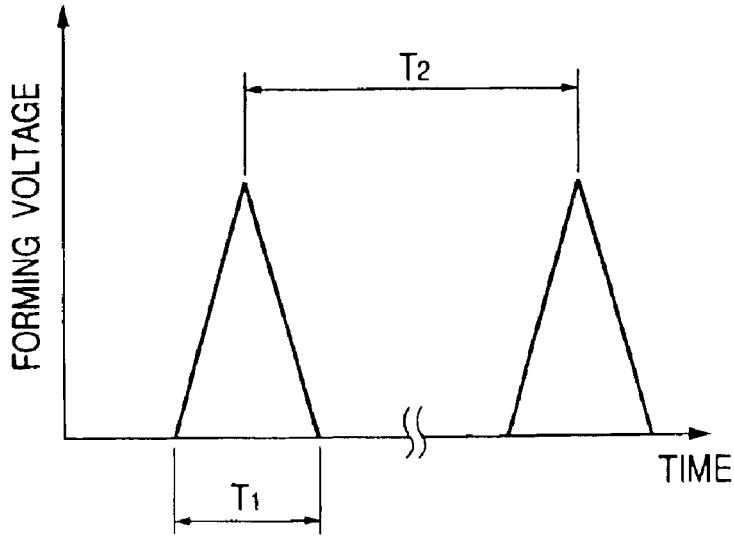
FIGS. 5A and 5B show the waveforms of pulse voltages used in the forming step when the electron-emitting device according to the embodiment of the present invention is prepared.
Figure 5B:
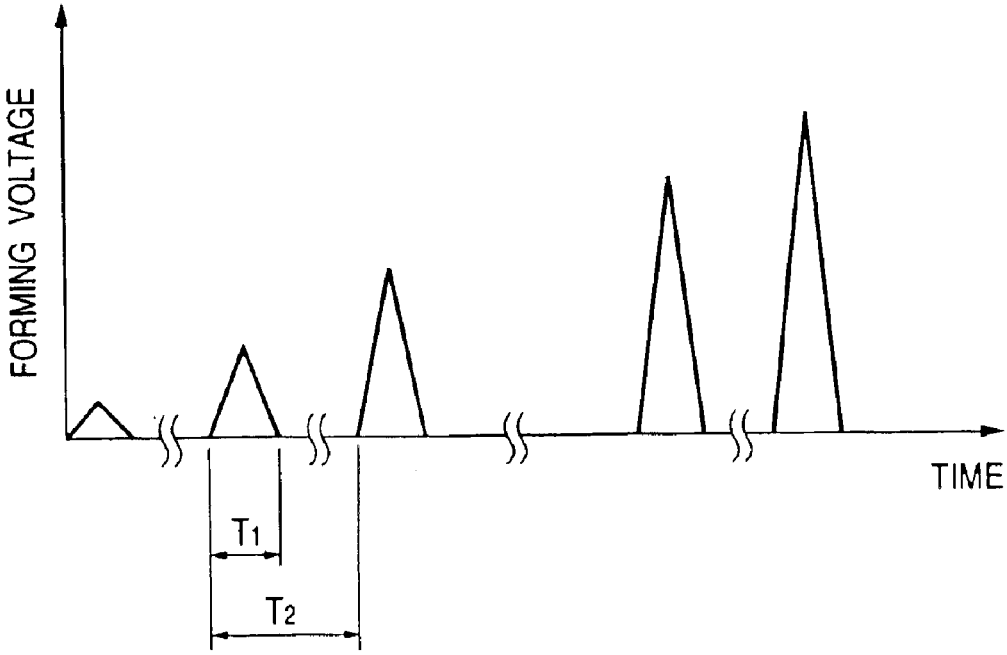

The waveform of the pulse voltage used in the forming is that shown in FIG. 5B, and the pulse width T1=1 msec. and the pulse interval T2=10 msec., and the processing was carried out with the crest value gradually raised at 0.1 V stop.

In the midst of this processing, a rectangular wave pulse of a crest value 0.1 V was inserted between the above-described pulses, and the current value was measured to thereby fined the resistance value of the device. At a point of time whereat the resistance value thus found exceeded IMΩ, the application of the pulse was stopped and the forming was terminated.

(Step-e)

Thus, the activating step is carried out. The exhaustion in the vacuum chamber is continued, and after the pressure in the chamber lowers to $1.3\times10^{-6}$ Pa, benzonitrile is introduced into the chamber through a show leak value mounted on the vacuum chamber. The show leak value is adjusted so that the pressure in the chamber, i.e., the pressure of benzonitrile may become $1.3\times10^{-4}$ Pa.

Figure 10:
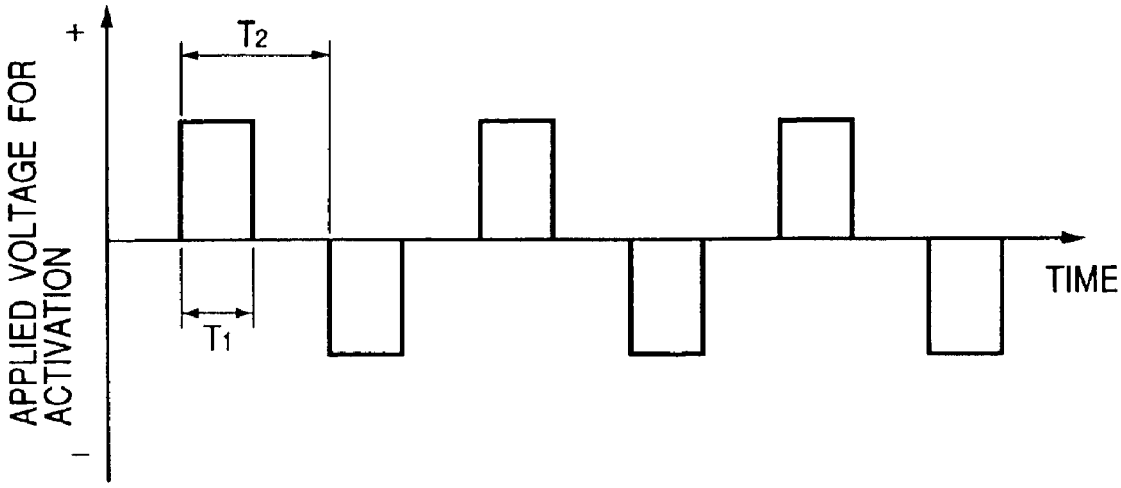
FIG. 10 shows the waveform of a pulse voltage used in the activating step when the electron-emitting device according to the embodiment of the present invention is prepared.

Then, a pulse voltage is applied to between the device electrodes 2 and 3. The waveform of the applied pulse is a rectangular wave pulse as shown in FIG. 10 wherein the polarity is reversed at each pulse, and with the pulse width T1=1 msec., the pulse interval T2=100 msec. And the pulse crest value=15 V, the application of the pulse was effected for 60 minutes. (The time of the pulse application is a time found by a preliminary study as the time until under this processing condition, the increase in the device current If is saturated.

Figure 3D:
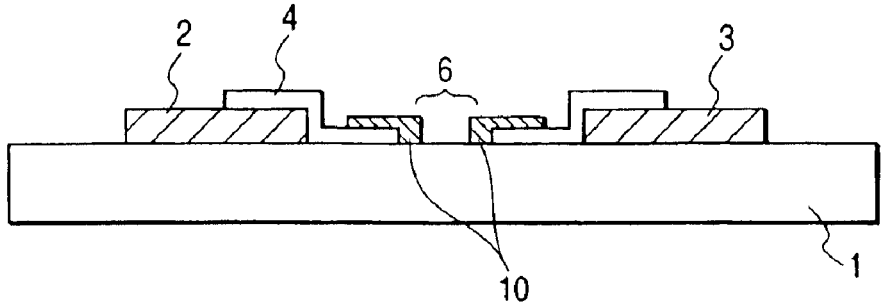

By this processing, deposits 10 composed chiefly of carbon were formed on an area including conductive film. The deposits 10 composed chiefly of carbon are piled in the fissure 5 so as to form a gap 6 narrower than the fissure 5 (FIG. 3D).

(Step-f)

The device is taken out of the vacuum chamber, and processing for causing Li to be contained in the deposits composed chiefly of carbon is effected.

A water solution of ethylene diamine tetraacetic acid-Li salt (Li-EDTA) was applied to the above-described device and was dried, and thereafter was subjected to heat treatment at 200° C. in vacuum. At this time, the quantity of the applied Li-EDTA water solution was adjusted to thereby control the quantity of Li.

There were prepared samples in which the quantity of Li to carbon was 1 mol % (Embodiment 1), 3 mol % (Embodiment 2), 5 mol % (Embodiment 3) and 7 mol % (comparative example 2). Further, for the purpose of comparison, there was also prepared a sample in which the addition of Li was not effected (comparative example 1).

The relation between the applied amount and the Li content was found by a preliminary study. At this time, the measurement of the Li content was effected by the photoelectron spectral method. The apparatus used is ESCA LAB 220I-XL produced by VG scientific Inc. In the measurement, the percentage of Li/C was found from the ls peak of Li and the ls peak of C (carbon) observed from an area having a side of 50 $\mu$m with the fissure as the center. The measurement limits of alkali metal element and alkali earth metal element are both of the order of 0.1 mol %.

In this preliminary study, any other alkali metal and alkali earth metal elements than Li were not detected. In the sample wherein the addition of Li was not done, neither including Li was not detected.

(Step-g)

Subsequently, the above-described device was again set in the vacuum apparatus, the interior of the vacuum chamber was evacuated, and the vacuum chamber and the device were maintained at 250° C. for 10 hours. This processing removes the molecules of water and organic substances adsorbed to the device and the interior of the vacuum chamber, and is called "stabilizing process".

Figure 4:
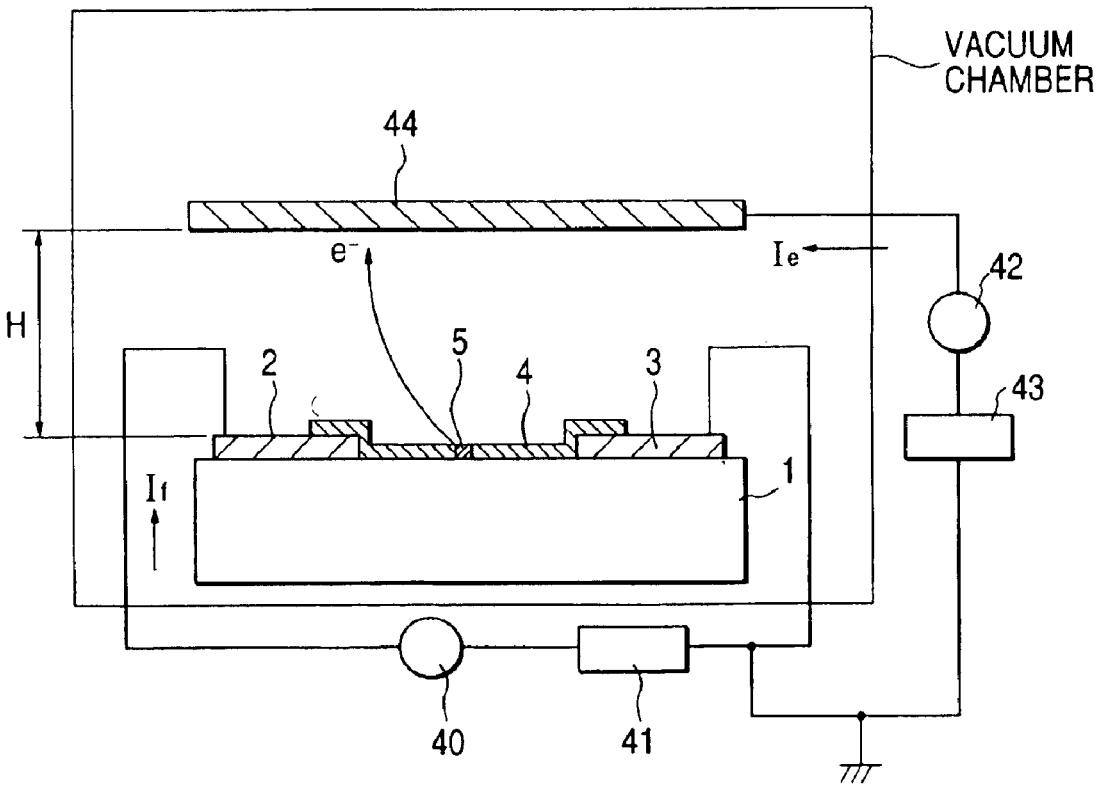
FIG. 4 is a block diagram showing the epitome of an evaluating apparatus for the electron-emitting device according to the embodiment of the present invention.

Regarding the device, the electron-emitting characteristic and a variation therein with time were measured by the use of an apparatus schematically shown in FIG. 4.

That is, a rectangular wave pulse of a pulse width 1 msec., a pulse interval 100 msec. and a crest value 15 V was applied to the device by a pulse generator 41. The interval H between the device and an anode electrode 44 was 4 mm. A constant voltage of 1 kV was applied to the anode electrode 44 by a high voltage source 43. At this time, the device current If and the emission current Ie were measured by an ammeter 40 and an ammeter 42, respectively, and electron-emitting efficiency $\eta$=(Ie/If) was found.

It has been found that when the driving of the device is continued, both of Ie and If are reduced, but when the content of Li becomes great to a certain degree, the reduction in Ie and If becomes fast as compared with a case where Li is not contained. The comparison between the value of the electron-emitting efficiency at the only stage of the measurement and the situation of the reduction in Ie and If is shown in Table 1 below.

TABLE 1

| | Comparative Example 1 | Embodiment 1 | Embodiment 2 | Embodiment 3 | Comparative Example 2 |
|---|---|---|---|---|---|
| Li/C (mol %) | 0 | 1.0 | 3.0 | 5.0 | 7.0 |
| $\eta$ (%) | 0.12 | 0.17 | 0.19 | 0.19 | 0.19 |
| variation with time | — | ○ | ○ | ○ | x |

In Table 1, ○ indicates that the situation of the reduction in Ie and If does not differ from that of a sample which does not contain Li (Comparative Example 1), and x indicates that the reduction in Ie and If is faster than in Comparative Example 1.

With regard also to the elements K, Na, Ca, Sr and Ba, samples were prepared by a technique similar to Embodiments 1 to 3 and Comparative Example 2, and evaluation was done. The addition of the respective elements was done by effecting heat treatment of 200° C. in vacuum after a water solution of ethylene diamine tetraacetic acid salt was applied to the respective elements and was dried.

The results are as follows.

TABLE 2

| | Embodiment 4 | Embodiment 5 | Embodiment 6 | Comparative Example 3 |
|---|---|---|---|---|
| K/C (nol %) | 1.0 | 3.0 | 5.0 | 7.0 |
| $\eta$ (%) | 0.18 | 0.19 | 0.20 | 0.19 |
| variation with time | ○ | ○ | ○ | x |

TABLE 3

| | Embodiment 7 | Embodiment 8 | Embodiment 9 | Comparative Example 4 |
|---|---|---|---|---|
| Na/C (nol %) | 1.0 | 3.0 | 5.0 | 7.0 |
| $\eta$ (%) | 0.18 | 0.19 | 0.19 | 0.19 |
| variation with time | ○ | ○ | ○ | x |

TABLE 4

| | Embodiment 10 | Embodiment 11 | Embodiment 12 | Comparative Example 5 |
|---|---|---|---|---|
| Ca/C (nol %) | 1.0 | 3.0 | 5.0 | 7.0 |
| $\eta$ (%) | 0.19 | 0.21 | 0.22 | 0.18 |
| variation with time | ○ | ○ | ○ | x |

TABLE 5

| | Embodiment 13 | Embodiment 14 | Embodiment 15 | Comparative Example 6 |
|---|---|---|---|---|
| Sr/C (nol %) | 1.0 | 3.0 | 5.0 | 7.0 |
| $\eta$ (%) | 0.18 | 0.20 | 0.21 | 0.19 |
| variation with time | ○ | ○ | ○ | x |

TABLE 6

| | Embodiment 16 | Embodiment 17 | Embodiment 18 | Comparative Example 7 |
|---|---|---|---|---|
| Ba/C (nol %) | 1.0 | 3.0 | 5.0 | 7.0 |
| $\eta$ (%) | 0.18 | 0.20 | 0.20 | 0.19 |
| variation with time | ○ | ○ | ○ | x |

As seen in the results shown in Tables 1 to 6, it has been found that with regard to any of the above-mentioned elements, 1 to 5 mol % is contained in the deposit composed chiefly of carbon, whereby the rise of the electron-emitting efficiency occurs, and as compared with cases where these elements are not contained, the variation in Ie and If with time does not become great and preferable results are obtained.

Further, a study similar to that in the above-described cases was made with regard to a case where equal amounts of K and Sr are contained. The result is as follows.

TABLE 7

| | Embodiment 19 | Embodiment 20 | Embodiment 21 | Comparative Example 8 |
|---|---|---|---|---|
| (K + Sr)/C (nol %) | 1.0 | 3.0 | 5.0 | 7.0 |
| $\eta$ (%) | 0.18 | 0.20 | 0.20 | 0.19 |

TABLE 7-continued

| | Embodiment 19 | Embodiment 20 | Embodiment 21 | Comparative Example 8 |
|---|---|---|---|---|
| variation with time | ○ | ○ | ○ | x |

It has been found that even when of the above-mentioned elements, a plurality of kinds are contained, the sum total thereof is 1 to 5 mol % in the deposit composed chiefly of carbon, whereby the rise of the electron-emitting efficiency occurs and as compared with cases where these elements are not contained, the variation in Ie and If with time does not become great, and preferable results are obtained.

(Embodiments of the Electron Source and the Image Forming Apparatus)

By disposing a plurality of electron-emitting devices according to the above-described embodiments of the present invention on a substrate, and forming wirings connected to these devices, an electron source can be formed.

Figure 6:
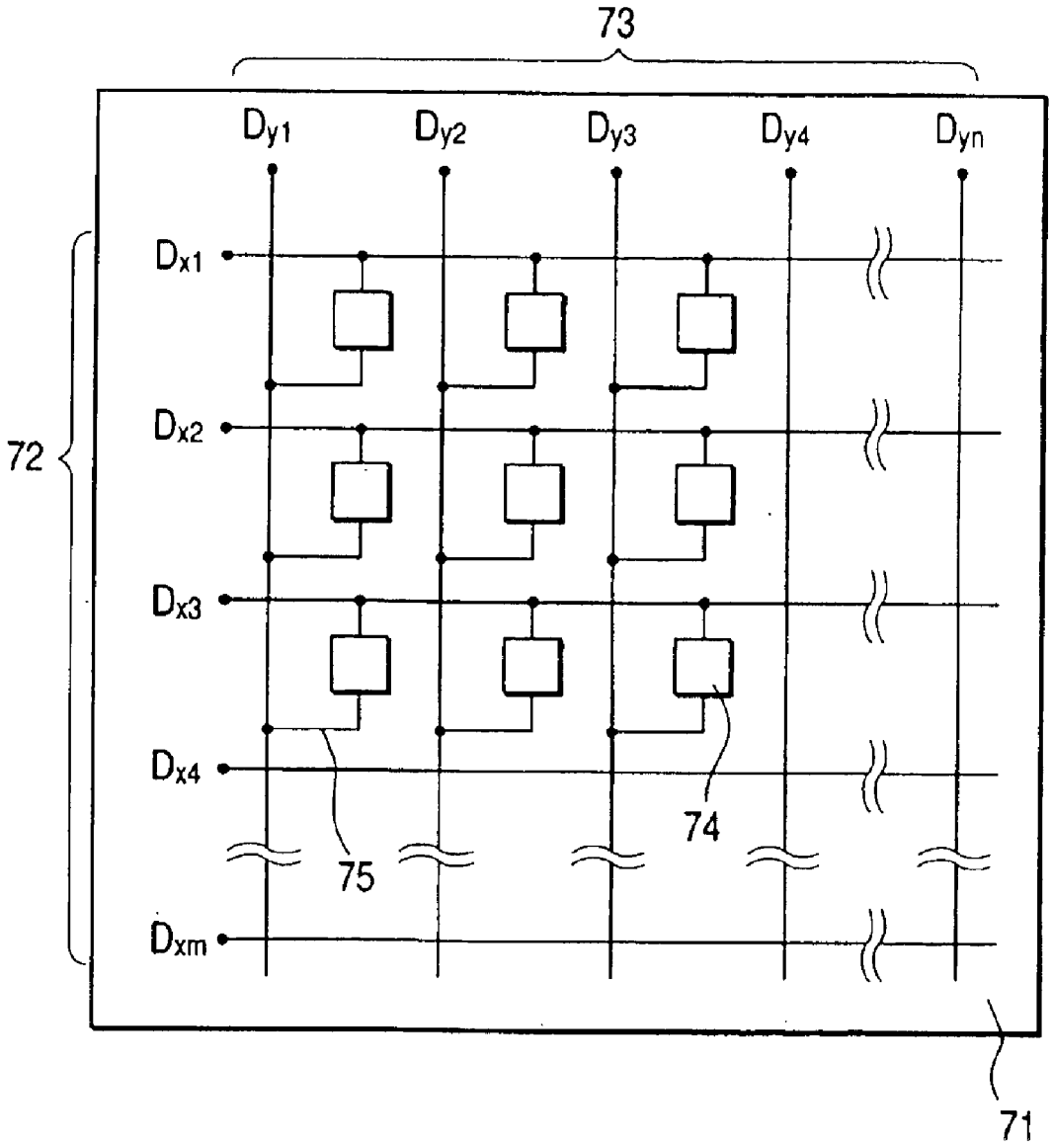
FIG. 6 is a typical view of an electron source according to an embodiment of the present invention.

An example of the construction is shown in FIG. 6. In FIG. 6, the reference numeral 71 designates a substrate, the reference numeral 72 denotes m X-direction wirings Dxl to Dxm, the reference numeral 73 designates n Y-direction wirings Dyl to Dyn, the reference numeral 74 denotes the electron-emitting devices according to the embodiments of the present invention, and the reference numeral 75 designates connecting wires connecting the above-described wirings and the device together. In the intersecting portions among the X-direction wirings and the Y-direction wirings, insulating layers, not shown, are disposed so as to electrically insulate the two.

Also, an image forming apparatus can be constituted by the above-described electron source and an image forming member for forming an image by the application of electrons emitted from the electron source.

Figure 7:
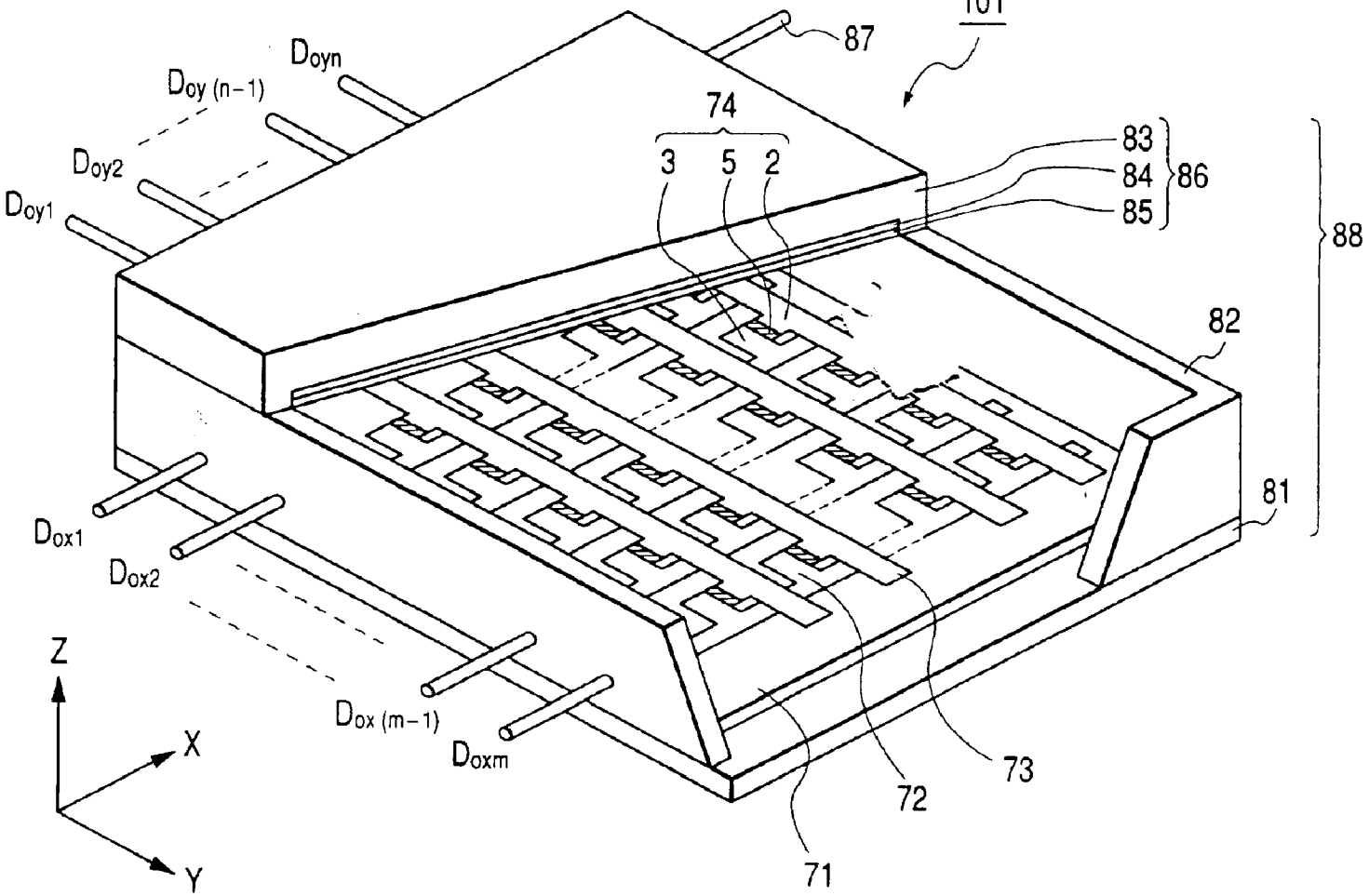
FIG. 7 is a typical, partly broken-away perspective view of an image forming apparatus using the electron source shown in FIG. 6.

An example of the construction is shown in FIG. 7. In FIG. 7, the reference numeral 81 denotes a rear plate, the reference numeral 82 designates a support frame, the reference numeral 83 denotes a glass substrate, and the reference numeral 86 designates a face plate, and an envelope 88 is constituted by these. The aforedescribed electron source is disposed in the envelope 88, and the interior of this envelope can be maintained air-tight.

Doxl to Doxm and Doyl to Doyn designate external terminals connected to the X-direction wirings Dxl–Dxm and the Y-direction wirings Dya to Dyn, respectively. The reference numeral 84 denotes an image forming member formed of phosphor, and the reference numeral 85 designates a metal back comprising metal evaporation film or the like, and it reflects a light emitted from the image forming member 84 toward the inside of the envelope 88 to the outside and improves the luminance thereof and also serves as an anode electrode for accelerating the electrons emitted from the electron source.

The reference numeral 87 denotes a high voltage terminal connected to the metal back, and it is connected to a voltage source for applying a high voltage to the metal back (anode electrode) 85.

In the illustrated example, the rear plate 81 and the substrate 71 of the electron source are provided discretely from each other, but when the substrate 71 has sufficient strength, it may serve also as the rear plate.

Figure 8:
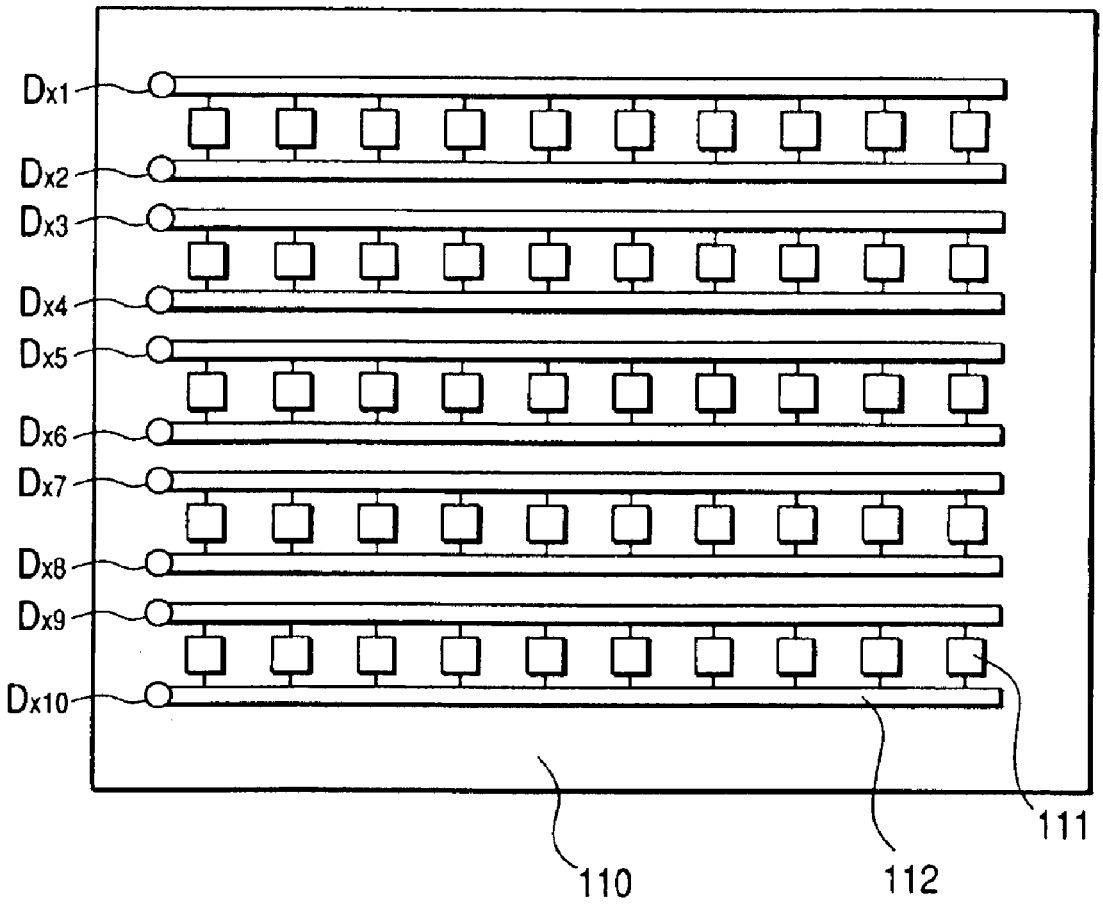
FIG. 8 is a typical view showing another construction of the electron source according to the embodiment of the present invention.

A construction as shown in FIG. 8 can also be adopted as the construction of the electron source. That is, a plurality of wirings 112 are formed in parallelism to one another on a substrate 110, and a plurality of electron-emitting devices 111 are disposed between a pair of wirings, whereby a plurality of device rows are formed.

Figure 9:
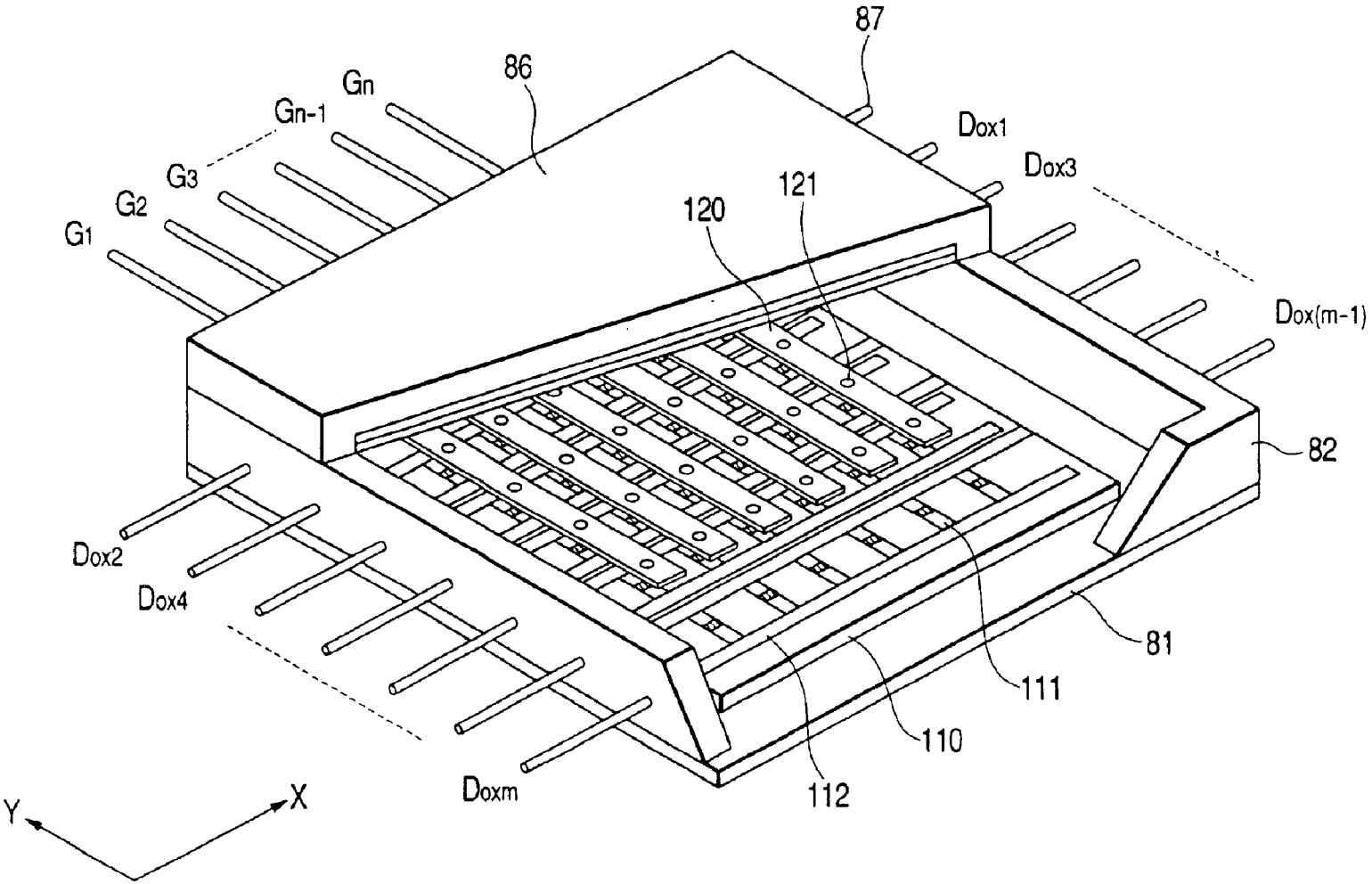
FIG. 9 is a typical, partly broken-away perspective view of an image forming apparatus using the electron source shown in FIG. 8.

An example of the construction of an image forming apparatus using the electron source of such a construction is shown in FIG. 9. In the case of such a construction, a plurality of grid electrodes 120 extending in a direction orthogonal to the direction of the device rows of the electron source are disposed, and have the function of modulating electron beams emitted from the electron-emitting devices belonging to one of the device rows which is selected by a driving circuit.

Each grid electrode has electron passing holes 121 for passing electrons therethrough at positions corresponding to the electron-emitting devices.

Doxl–Doxm designate external terminals connected to the above-described wirings. In FIG. 9, there is shown a case where odd-numbered wirings and even-numbered wirings are taken out from the side of the opposite support frame. G1 to Gn denote grid external terminals connected to respective ones of the above-described grid electrodes.

As described above, the present invention could improve the electron-emitting efficiency within a range in which adverse effect did not appear regarding the variation with time by driving, by containing in the piled films composed chiefly of carbon one or more kinds of elements selected from the group of lithium, potassium, sodium, calcium, strontium and barium within the range of 1 mol % to 5 mol % in terms of the percentage to carbon.

What is claimed is:

1. An electron-emitting device having a pair of electric conductors disposed on a substrate and a pair of films composed chiefly of carbon and connected to said pair of electric conductors and disposed with a gap interposed therebetween, characterized in that said films contain therein one or more kinds of elements selected from the group consisting of lithium, potassium, sodium, calcium, strontium and barium within the range of 1 mol % to 5 mol % in terms of the percentage to carbon.

2. An electron-emitting device provided with a pair of device electrodes disposed on a substrate, an electrically conductive film connected to said pair of device electrodes and having a fissure between the pair of device electrodes, and a carbon film composed chiefly of carbon and formed in said fissure and on an area including said fissure and having in said fissure a gap of a width narrower than said fissure, characterized in that said carbon film contains therein one or more kinds of elements selected from the group consisting of lithium, potassium, sodium, calcium, strontium and barium within the range of 1 mol % to 5 mol % in terms of the percentage to carbon.

3. An electron source comprising a plurality of electron-emitting devices disposed on a substrate, and wirings connected to said electron-emitting devices, each electron-emitting device comprising a pair of electric conductors disposed on the substrate and a pair of films composed chiefly of carbon and connected to said pair of electric conductors and disposed with a gap interposed therebetween, wherein said films contain therein one or more kinds of elements selected from the group consisting of lithium, potassium, sodium, calcium, strontium and barium within the range of 1 mol % to 5 mol % in terms of the percentage to carbon.

4. An image forming apparatus comprising an electron source, and an image forming member for effecting image formation by electrons emitted from said electron source colliding against it, the electron source comprising a plurality of electron-emitting devices disposed on a substrate, and wirings connected to said electron-emitting devices, each electron-emitting device comprising a pair of electric conductors disposed on the substrate and a pair of films composed chiefly of carbon and connected to said pair of electric conductors and disposed with a gap interposed therebetween, wherein said films contain therein one or more kinds of elements selected from the group consisting of lithium, potassium, sodium, calcium, strontium and barium within the range of 1 mol % to 5 mol % in terms of the percentage to carbon.

5. An electron-emitting device comprising a pair of electric conductors disposed on a substrate and a pair of films composed chiefly of carbon and connected to said pair of electric conductors and disposed with a gap interposed therebetween, wherein said films contain therein one or more kinds of elements selected from the group consisting of lithium, potassium, sodium, calcium, strontium and barium of 5 mol % or less in terms of the percentage of carbon.

6. An electron-emitting device comprising a pair of device electrodes disposed on a substrate, an electrically conductive film connected to said pair of device electrodes and having a fissure between the pair of device electrodes, and a carbon film composed chiefly of carbon and formed in said fissure and on an area including said fissure and having in said fissure a gap of a width narrower than said fissure, wherein said carbon film contains therein one or more kinds of elements selected from the group consisting of lithium, potassium, sodium, calcium, strontium and barium of 5 mol % or less in terms of the percentage to carbon.

7. An electron source comprising a plurality of electron-emitting devices disposed on a substrate, and wirings connected to said electron-emitting devices, each electron-emitting device comprising a pair of electric conductors disposed on the substrate and a pair of films composed chiefly of carbon and connected to said pair of electric conductors and disposed with a gap interposed therebetween, wherein said films contain therein one or more kinds of elements selected from the group consisting of lithium, potassium, sodium, calcium, strontium and barium of 5 mol % or less in terms of the percentage of carbon.

8. An image forming apparatus comprising an electron source, and an image forming member for effecting image formation by electrons emitted from said electron source colliding against it, the electron source comprising a plurality of electron-emitting devices disposed on a substrate, and wirings connected to said electron-emitting devices, each electron-emitting device comprising a pair of electric conductors disposed on the substrate and a pair of films composed chiefly of carbon and connected to said pair of electric conductors and disposed with a gap interposed therebetween, wherein said films contain therein one or more kinds of elements selected from the group consisting of lithium, potassium, sodium, calcium, strontium and barium of 5 mol % or less in terms of the percentage of carbon.

9. An electron-emitting device, comprising:

a carbon film composed chiefly of carbon; and an electrode electrically connected to the carbon film, wherein the carbon film contains therein one or more kinds of elements selected from the group consisting of lithium, potassium, sodium, calcium, strontium, and barium of 5 mol % or less in terms of the percentage to carbon.

10. An electron-emitting device, comprising:

a carbon film composed chiefly of carbon; and an electrode electrically connected to the carbon film, wherein the carbon film contains therein one or more kinds of elements selected from the group consisting of lithium, potassium, sodium, calcium, strontium, and barium of within the range of 1 mol % to 5 mol % in terms of the percentage to carbon.

11. An electron source, comprising:

a substrate;

a plurality of electron-emitting devices disposed on the substrate, each electron-emitting device comprising:

a carbon film composed chiefly of carbon, and an electrode electrically connected to the carbon film, wherein the carbon film contains therein one or more kinds of elements selected from the group consisting of lithium, potassium, sodium, calcium, strontium, and barium of 5 mol % or less in terms of the percentage to carbon; and wirings connected to the plurality of electron-emitting devices.

12. An electron source, comprising:

a substrate;

a plurality of electron-emitting devices disposed on the substrate, each electron-emitting device comprising:

a carbon film composed chiefly of carbon, and an electrode electrically connected to the carbon film, wherein the carbon film contains therein one or more kinds of elements selected from the group consisting of lithium, potassium, sodium, calcium, strontium, and barium of within the range of 1 mol % to 5 mol % in terms of the percentage to carbon; and wirings connected to the plurality of electron-emitting devices.

13. An image-forming apparatus, comprising:

an image forming member; and an electron source, comprising:

a substrate;

a plurality of electron-emitting devices disposed on the substrate, each electron-emitting device comprising:

a carbon film composed chiefly of carbon, and an electrode electrically connected to the carbon film, wherein the carbon film contains therein one or more kinds of elements selected from the group consisting of lithium, potassium, sodium, calcium, strontium, and barium of 5 mol % or less in terms of the percentage to carbon; and wirings connected to the plurality of electron-emitting devices.

14. An image-forming apparatus, comprising:

an image forming member; and an electron source, comprising:

a substrate;

a plurality of electron-emitting devices disposed on the substrate, each electron-emitting device comprising:

a carbon film composed chiefly of carbon, and an electrode electrically connected to the carbon film, wherein the carbon film contains therein one or more kinds of elements selected from the group consisting of lithium, potassium, sodium, calcium, strontium, and barium of within the range of 1 mol % to 5 mol % in terms of the percentage to carbon; and wirings connected to the plurality of electron-emitting devices.

15. An electron-emitting device, comprising:

a carbon film composed chiefly of carbon; and an electrode electrically connected to the carbon film, wherein one or more elements selected from the group consisting of lithium, potassium, sodium, calcium, strontium, and barium are contained in the carbon film in a rate of 1 mol % or more with respect to carbon.

16. An electron source, comprising:

a substrate;

a plurality of electron-emitting devices disposed on the substrate, each electron-emitting device being an electron-emitting device comprising:

a carbon film composed chiefly of carbon, and an electrode electrically connected to the carbon film, wherein one or more elements selected from the group consisting of lithium, potassium, sodium, calcium, strontium, and barium are contained in the carbon film in a rate of 1 mol % or more with respect to carbon; and wirings connected to the electron-emitting devices.

17. An image-forming apparatus, comprising:

an electron source comprising:

a substrate, a plurality of electron-emitting devices disposed on the substrate, each electron-emitting device comprising:

a carbon film composed chiefly of carbon, and an electrode electrically connected to the carbon film, wherein one or more elements selected from the group consisting of lithium, potassium, sodium, calcium, strontium, and barium are contained in the carbon film in a rate of 1 mol % or more with respect to carbon, and wirings connected to the electron-emitting devices; and a phosphor.

18. An electron source comprising a plurality of electron-emitting devices disposed on a substrate, and wirings connected to said electron-emitting devices, each electron-emitting device comprising a pair of device electrodes disposed on the substrate, an electrically conductive film connected to said pair of device electrodes and having a fissure between the pair of device electrodes, and a carbon film composed chiefly of carbon and formed in said fissure and on an area including said fissure and having in said fissure a gap of a width narrower than said fissure, wherein said carbon film contains therein one or more kinds of elements selected from the group consisting of lithium, potassium, sodium, calcium, strontium and barium within the range of 1 mol % to 5 mol % in terms of the percentage to carbon.

19. An image-forming apparatus comprising an electron source and an image forming member for effecting image formation by electrons emitted from said electron source colliding against it, said electron source comprising a plurality of electron-emitting devices disposed on a substrate, and wirings connected to said electron-emitting devices, each electron-emitting device comprising a pair of device electrodes disposed on the substrate, an electrically conductive film connected to said pair of device electrodes and having a fissure between the pair of device electrodes, and a carbon film composed chiefly of carbon and formed in said fissure and on an area including said fissure and having in said fissure a gap of a width narrower than said fissure, wherein said carbon film contains therein one or more kinds of elements selected from the group consisting of lithium, potassium, sodium, calcium, strontium and barium within the range of 1 mol % to 5 mol % in terms of the percentage to carbon.

20. An electron source comprising a plurality of electron-emitting devices disposed on a substrate, and wirings connected to said electron-emitting devices, each electron-emitting device comprising a pair of device electrodes disposed on the substrate, an electrically conductive film connected to said pair of device electrodes and having a fissure between the pair of device electrodes, and a carbon film composed chiefly of carbon and formed in said fissure and on an area including said fissure and having in said fissure a gap of a width narrower than said fissure, wherein said carbon film contains therein one or more kinds of elements selected from the group consisting of lithium, potassium, sodium, calcium, strontium and barium of 5 mol % or less in terms of percentage to carbon.

21. An image-forming apparatus comprising an electron source and an image forming member for effecting image formation by electrons emitted from said electron colliding against it, said electron source comprising a plurality of electron-emitting devices disposed on a substrate, and wirings connected to said electron-emitting devices, each electron-emitting device comprising a pair of device electrodes disposed on a substrate, an electrically conductive film connected to said pair of device electrodes and having a fissure between the pair of device electrodes, and a carbon film composed chiefly of carbon and formed in said fissure and on an area including said fissure and having in said fissure a gap of a width narrower than said fissure, wherein said carbon film contains therein one or more kinds of elements selected from the group consisting of lithium, potassium, sodium, calcium, strontium and barium of 5 mol % or less in terms of the percentage to carbon.

* * * * *

UNITED STATES PATENT AND TRADEMARK OFFICE

CERTIFICATE OF CORRECTION

PATENT NO. : 6,876,156 B1
APPLICATION NO. : 09/513129
DATED : April 5, 2005
INVENTOR(S) : Keisuke Yamamoto et al.

It is certified that error appears in the above-identified patent and that said Letters Patent is hereby corrected as shown below:

ON COVER PAGE AT (*) NOTICE

Insert: -- This patent issued on a continued prosecution application filed under 37 C.F.R. 1.53(d), and is subject to the twenty year patent term provisions of 35 U.S.C. § 154(a)(2).--.

ON COVER PAGE AT (56) U.S. PATENT DOCUMENTS

Insert: --5,728,435 3/1998 Geis et al.--.

ON COVER PAGE AT (56) FOREIGN PATENT DOCUMENTS

"JP 7-235255 9/1995" should be deleted.

COLUMN 2

Line 10, "even" should read --ever--;
Line 25, "relation ship" should read --relationship--; and
Line 53, "are" should be deleted.

COLUMN 3

Line 30, "at the deposit" should read --deposit and--.

COLUMN 5

Line 47, "By the vacuum" should read --(Step-b) ¶ By the vacuum--.

COLUMN 6

Line 14, "fined" should read --find--.

COLUMN 10

Line 26, "having" should read --comprising--;
Line 30, "characterized in that" should read --wherein--;
Line 34, "provided with" should read --comprising--;
Line 41, "characterized in that" should read --wherein--.

UNITED STATES PATENT AND TRADEMARK OFFICE

CERTIFICATE OF CORRECTION

PATENT NO. : 6,876,156 B1
APPLICATION NO. : 09/513129
DATED : April 5, 2005
INVENTOR(S) : Keisuke Yamamoto et al.

It is certified that error appears in the above-identified patent and that said Letters Patent is hereby corrected as shown below:

COLUMN 13

Line 16, "substrate," should read --substrate;--.

Signed and Sealed this

Twentieth Day of March, 2007

JON W. DUDAS
*Director of the United States Patent and Trademark Office*